US011293599B1

(12) United States Patent
Wang

(10) Patent No.: US 11,293,599 B1
(45) Date of Patent: Apr. 5, 2022

(54) MULTI-RESISTOR WATERPROOF BULB STRUCTURE

(71) Applicant: DONGGUAN HUIHUAN LIGHTING CO., LTD., Dongguan (CN)

(72) Inventor: Song Wang, Chengdu (CN)

(73) Assignee: DONGGUAN HUIHUAN LIGHTING CO., LTD., Dongguan (CN)

( * ) Notice: Subject to any disclaimer, the term of this patent is extended or adjusted under 35 U.S.C. 154(b) by 0 days.

(21) Appl. No.: 17/394,344

(22) Filed: Aug. 4, 2021

(30) Foreign Application Priority Data

Dec. 25, 2020 (CN) ..... 202023186343.1

(51) Int. Cl.

| | |
|---|---|
| ***F21K 9/238*** | (2016.01) |
| ***F21V 31/04*** | (2006.01) |
| ***F21K 9/90*** | (2016.01) |
| ***F21V 31/00*** | (2006.01) |
| ***F21K 9/232*** | (2016.01) |
| *F21Y 103/10* | (2016.01) |
| *F21Y 115/10* | (2016.01) |

(52) U.S. Cl.
CPC ..... *F21K 9/238* (2016.08); *F21K 9/232* (2016.08); *F21K 9/90* (2013.01); *F21V 31/005* (2013.01); *F21V 31/04* (2013.01); *F21Y 2103/10* (2016.08); *F21Y 2115/10* (2016.08)

(58) Field of Classification Search
CPC ..... F21K 9/238; F21K 9/237; F21K 9/232; F21V 31/04; F21V 31/005
See application file for complete search history.

(56) References Cited

U.S. PATENT DOCUMENTS

| | | | | |
|---|---|---|---|---|
| 11,215,327 | B1 * | 1/2022 | Wang | F21K 9/238 |
| 11,231,172 | B1 * | 1/2022 | Wu | F21K 9/232 |
| 2010/0320890 | A1 * | 12/2010 | Jung | F25D 27/00 312/405 |

* cited by examiner

*Primary Examiner* — Karabi Guharay

(57) ABSTRACT

The disclosure relates to the technical field of bulbs, and discloses a multi-resistor waterproof bulb structure including a plastic base and at least one resistor. A first metal support wire passes through a first clamping seat to a first guide hole in sequence and clamps and fixes the resistor into the seat, and the wire extends outward and is electrically connected to a strip light. The disclosure has the following advantages: 1. By changing the structure, the resistor is directly clamped to the plastic base, so the clamping and fixation effects are good. 2. The assembly is easier: the resistor can be directly inserted into the clamping seat to realize fixation, and no displacement will occur to the resistor, so that the resistor is more stable in subsequent welding. 3. A process of pressing and fixing the resistor is eliminated, thereby saving the production and manufacturing cost.

8 Claims, 2 Drawing Sheets

MULTI-RESISTOR WATERPROOF BULB STRUCTURE

TECHNICAL FIELD

The disclosure relates to the technical field of bulbs, and in particular to a multi-resistor waterproof bulb structure.

BACKGROUND

Bulbs are main luminaires used for lighting. With the development of technology, from traditional tungsten bulbs to LED chip bulbs, LED strip light bulbs and the like at present, various bulbs have become common.

Existing LED bulbs, especially bulb structures using LED strip lights, often have the problem of water entering the envelope due to climate, environment, rain and the like in actual use, so that the LED strip light is damaged, or water vapor becomes mist in the envelope, which affects the use. Therefore, inventors have made a new invention.

SUMMARY

In view of the defects in the prior art, an objective of the disclosure is to provide a multi-resistor waterproof bulb structure, which has the advantages of good waterproofness and easy realization of automatic assembly.

In order to realize the above objective, the multi-resistor waterproof bulb structure of the disclosure includes a cap and an envelope, and further includes a stem assembly and a sealing elastomer base with an elastic waterproof seal. The stem assembly includes a first resistor, an LED strip light and a second resistor electrically connected in sequence. The first resistor includes a resistor a, one end of the resistor a is connected with a first wire, and the other end of the resistor a is connected with a second wire. The second resistor includes a resistor b, one end of the resistor b is connected with a third wire, and the other end of the resistor a is connected with a fourth wire. The sealing elastomer base is provided with two blind holes respectively for accommodating the resistor a and the resistor b, the resistor a and the resistor b are accommodated in the blind holes in tight fit, the first wire and the fourth wire respectively penetrate through the blind holes, the first wire is electrically connected to an electrode of the cap, the fourth wire is electrically connected to another electrode of the cap, the sealing elastomer base is in seal and tight fit with an inner side of an opening of the envelope, and the cap is fixedly connected to an outer side of the opening of the envelope.

Further, the sealing elastomer base includes a cylinder portion for waterproof sealing, an upper part of the cylinder portion is connected with a support portion, and a lower part of the cylinder portion is provided with a flange.

Preferably, two sides of the support portion are provided with symmetrical assembly planes.

Further, glue is applied between the cap and the outer side of the opening of the envelope, and the cap is threadedly connected to the envelope with an air escape gap reserved.

Further, a diameter of the second wire is greater than a diameter of the first wire, and a diameter of the third wire is greater than a diameter of the fourth wire.

Further, the resistor a and the resistor b are in interference fit with the blind holes.

Further, the sealing elastomer base is formed of silicone or rubber.

Further, a water escape gap is reserved at a bottom electrode of the cap.

Beneficial effects: Compared with the prior art, the multi-resistor waterproof bulb structure of the disclosure includes the cap and envelope, and further includes the stem assembly and the sealing elastomer base with the elastic waterproof seal. The disclosure has the following advantages: 1. Under the actions of the fit of the sealing elastomer base and the resistors with the blind holes as well as the sealing of the sealing elastomer base with the opening of the envelope, the problem of water entering the envelope is solved, so that the service life of the luminaire is longer. 2. The direct use of the double resistors can quickly enhance the automation degree of assembly of the stem assembly.

Reference signs includes:

Cap—1, envelope—2, stem assembly—3, first resistor—31, resistor a—311, first wire—312, second wire—313, LED strip light—32, second resistor—33, resistor b—331, third wire—332, fourth wire—333, sealing elastomer base—4, blind hole—41, cylinder portion—42, support portion—43, flange—44, assembly plane—45, air escape gap—5, and water escape gap—6.

DETAILED DESCRIPTION

Figure 1:
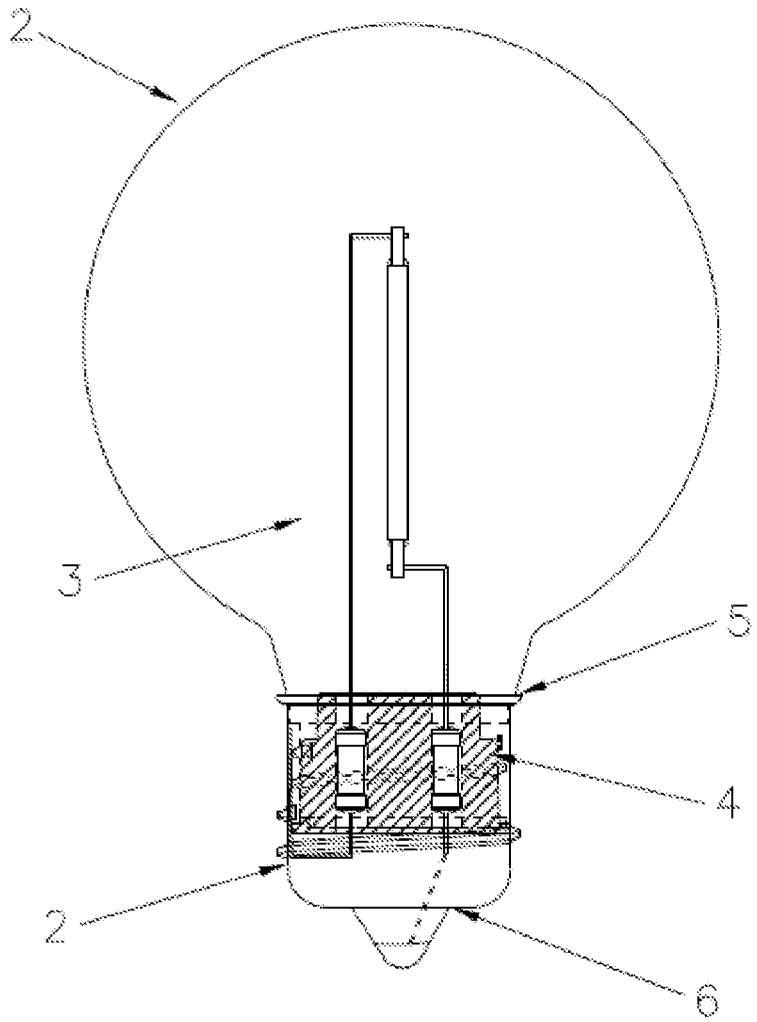
FIG. 1 is a schematic structural diagram of a bulb according to the disclosure.
Figure 2:
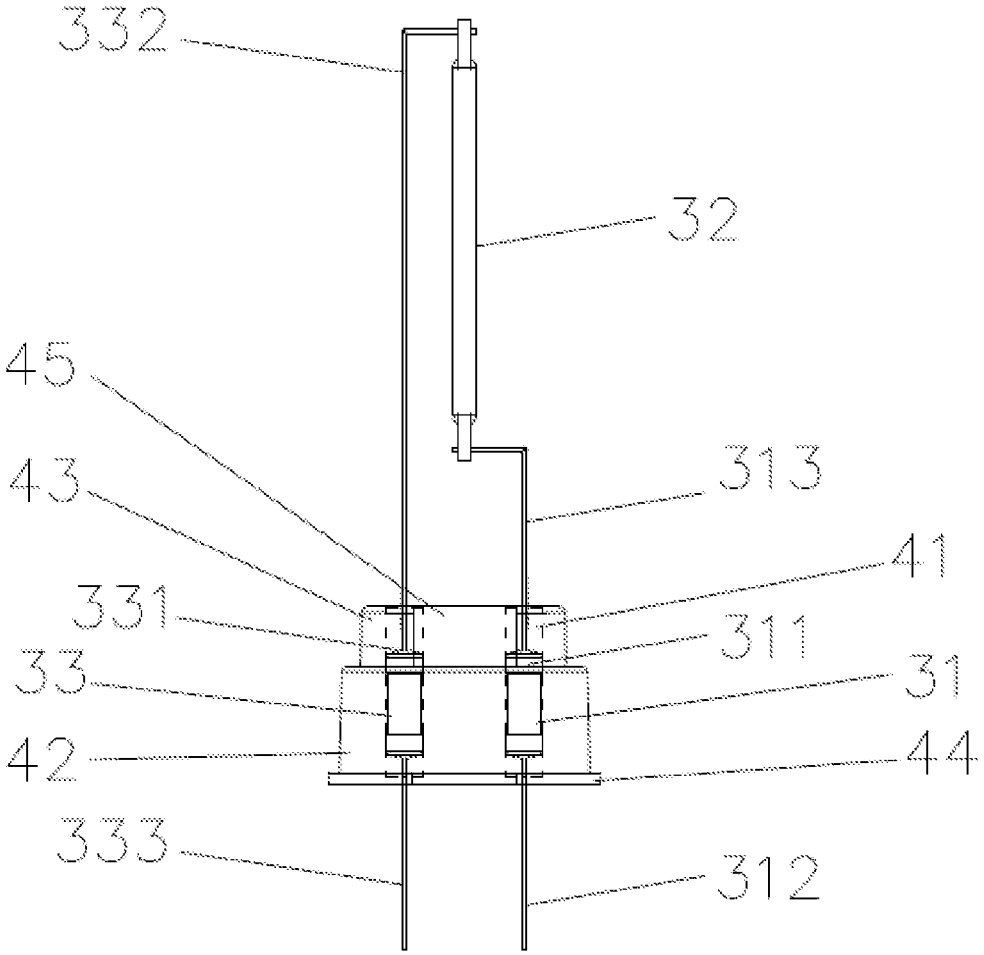
FIG. 2 is a structural diagram of a stem assembly according to the disclosure.

The disclosure will be described in detail below with reference to FIG. 1 to FIG. 2.

A multi-resistor waterproof bulb structure of the disclosure, which is embodied in a waterproof structure of a bulb product in one aspect, mainly includes a cap 1 and an envelope 2, and further includes a stem assembly 3 and a sealing elastomer base 4 with an elastic waterproof seal. The stem assembly 3 includes a first resistor 31, an LED strip light 32 and a second resistor 33 electrically connected in sequence. The first resistor 31 includes a resistor a311, one end of the resistor a is connected with a first wire 312, and the other end of the resistor a is connected with a second wire 313. The second resistor 33 includes a resistor b331, one end of the resistor b is connected with a third wire 332, and the other end of the resistor a is connected with a fourth wire 333. The use of the two resistors in the stem assembly 3 can prevent high temperature caused by the operation of a single resistor to the greatest extent, balance the luminaire and overcome the instability caused by the concentration of temperature during the operation of the single resistor. The sealing elastomer base 4 is provided with two blind holes 41 respectively for accommodating the resistor a and the resistor b. In the disclosure, the blind holes play an extremely important role. Therefore, when the resistor a and the resistor b are accommodated in the blind holes 41 in tight fit, the first wire and the fourth wire located at the lower ends of the resistors respectively penetrate through the blind holes 41 and then are electrically connected. At this time, the first wire and the fourth wire can easily penetrate through the sealing elastomer base 4 due to the elasticity in the assembly process, and after the penetration, the sealing elastomer base 4 can form an end seal to the first wire and the fourth wire also due to its elasticity. It should be emphasized that even if a seal failure occurs to an individual end seal, the resistor a, the resistor b and the blind holes can also form a seal against water or water vapor or the like in the case of use of the structure in which the resistor a and the resistor b are accommodated in the blind holes in tight fit, thereby preventing the water or water vapor from entering the inside of the envelope. In the disclosure, the first wire is electrically connected to an electrode (that is, usually the positive electrode) of the cap, the fourth wire is connected to another electrode (that is, usually the negative electrode) of the cap, the sealing elastomer base is in seal and tight fit with an inner side of an opening of the envelope, and the cap is fixedly connected to an outer side of the opening of the envelope. In conclusion, it can be seen that under the actions of the sealing of the sealing elastomer base with the opening of the envelope, the sealing of the sealing elastomer base 4 with the first wire and the fourth wire, and the seal fit of the resistor a and the resistor b with the blind holes, the waterproof bulb achieves multiple sealing, thereby realizing comprehensive waterproof effects.

The direct use of the double resistors is also beneficial to quickly enhancing the automation degree of the stem assembly and the product. The corresponding prior art uses a single resistor+single wire structure. In the prior art, the resistor and the wire need to be assembled separately, the single wire can be assembled only after a hole is made in the base in advance, and for the convenience of the assembly, a diameter of the hole made previously must be greater than that of the wire such that the wire can pass through the hole conveniently. However, after the finished product is obtained, water may easily enter through the hole. Therefore, the prior art not only fails to solve the problem in waterproofness, but also has relatively low efficiency. According to the present solution, in the case that the problem in waterproofness is solved, the two resistors are automatically in tight fit with the blind holes at one time by using resistor braiding, so that the production and manufacturing efficiency can be greatly enhanced.

In the present technical solution, the sealing elastomer base 4 includes a cylinder portion 42 for waterproof sealing, an upper part of the cylinder portion is connected with a support portion 43, and a lower part of the cylinder portion is provided with a flange 44. The cylinder portion 42 is sealed with the opening of the envelope 2, and the flange 44 is used to cover the opening of the envelope 2 so as to enhance the sealing performance.

In order to enhance the convenience of assembly, two sides of the support portion 43 are provided with symmetrical assembly planes 45. Thus, the cross-sectional area of the support portion 43 can be greatly reduced, which is beneficial to quickly realizing locating assembly.

In the present technical solution, glue is applied between the cap and the outer side of the opening of the envelope. The glue is used to enhance connection and fixation between the cap and the envelope. In order to discharge water that enters the cap due to use environments and the like, the cap is threadedly connected to the envelope with an air escape gap 5 reserved. When the luminaire is in use, heat of the luminaire will evaporate water in the cap, thereby keeping the inside of the cap dry and reducing water accumulation.

Since the disclosure mainly uses the resistors as the main support, in order to enhance the supporting effect, a diameter of the second wire is greater than a diameter of the first wire, and a diameter of the third wire is greater than a diameter of the fourth wire. In this way, on the premise of ensuring the supporting effect, wire consumables for resistors can be saved to the greatest extent, thereby reducing the cost.

In the present technical solution, the resistor a and the resistor b are in interference fit with the blind holes. This interference fit can also have a sealing effect similar to the tight fit.

In the present technical solution, the sealing elastomer base 4 is formed of silicone or rubber. If the silicone is used, the cost can be saved to the greatest extent. If the rubber is used, the sealing effect can also be realized.

In order to further enhance the volatilization or discharge of water entering the cap, a water escape gap 6 is reserved at a bottom electrode of the cap.

The above contents are only preferred examples of the disclosure. For those of ordinary skill in the art, according to the spirit of the disclosure, there will be changes in the specific implementation and the application scope. The contents of the specification should not be construed as limiting the disclosure.

What is claimed is:

1. A multi-resistor waterproof bulb structure, comprising a cap and an envelope, and further comprising a stem assembly and a sealing elastomer base with an elastic waterproof seal, wherein the stem assembly comprises a first resistor, an LED strip light and a second resistor electrically connected in sequence, the first resistor comprises a resistor a, one end of the resistor a is connected with a first wire, the other end of the resistor a is connected with a second wire, the second resistor comprises a resistor b, one end of the resistor b is connected with a third wire, and the other end of the resistor a is connected with a fourth wire; and the sealing elastomer base is provided with two blind holes respectively for accommodating the resistor a and the resistor b, the resistor a and the resistor b are accommodated in the blind holes in tight fit, the first wire and the fourth wire respectively penetrate through the blind holes, the first wire is electrically connected to an electrode of the cap, the fourth wire is electrically connected to another electrode of the cap, the sealing elastomer base is in seal and tight fit with an inner side of an opening of the envelope, and the cap is fixedly connected to an outer side of the opening of the envelope.

2. The multi-resistor waterproof bulb structure according to claim 1, wherein the sealing elastomer base comprises a cylinder portion for waterproof sealing, an upper part of the cylinder portion is connected with a support portion, and a lower part of the cylinder portion is provided with a flange.

3. The multi-resistor waterproof bulb structure according to claim 2, wherein two sides of the support portion are provided with symmetrical assembly planes.

4. The multi-resistor waterproof bulb structure according to claim 1, wherein glue is applied between the cap and the outer side of the opening of the envelope, and the cap is threadedly connected to the envelope with an air escape gap reserved.

5. The multi-resistor waterproof bulb structure according to claim 1, wherein a diameter of the second wire is greater than a diameter of the first wire, and a diameter of the third wire is greater than a diameter of the fourth wire.

6. The multi-resistor waterproof bulb structure according to claim 1, wherein the resistor a and the resistor b are in interference fit with the blind holes.

7. The multi-resistor waterproof bulb structure according to claim 1, wherein the sealing elastomer base is formed of silicone or rubber.

8. The multi-resistor waterproof bulb structure according to claim 7, wherein a water escape gap is reserved at a bottom electrode of the cap.

* * * * *